US007774125B2

(12) United States Patent
Scharfenberg

(10) Patent No.: US 7,774,125 B2
(45) Date of Patent: Aug. 10, 2010

(54) PROGRAMMABLE FUEL PUMP CONTROL

(75) Inventor: Robert E. Scharfenberg, St. Louis, MO (US)

(73) Assignee: Fluid Control Products, Inc., Litchfield, IL (US)

( * ) Notice: Subject to any disclaimer, the term of this patent is extended or adjusted under 35 U.S.C. 154(b) by 192 days.

(21) Appl. No.: 12/221,740

(22) Filed: Aug. 6, 2008

(65) Prior Publication Data

US 2010/0036585 A1 Feb. 11, 2010

(51) Int. Cl.
*F02D 41/30* (2006.01)

(52) U.S. Cl. ..... 701/103; 123/456; 123/446

(58) Field of Classification Search ..... 701/103–105, 701/102, 115; 123/456, 446, 497, 502, 505
See application file for complete search history.

(56) References Cited

U.S. PATENT DOCUMENTS

| | | | | |
|---|---|---|---|---|
| 3,168,102 | A | | 2/1965 | Tyler et al. |
| 3,919,981 | A | | 11/1975 | Reddy |
| 4,240,382 | A | | 12/1980 | Reddy |
| 4,278,061 | A | | 7/1981 | Werner et al. |
| 4,494,509 | A | | 1/1985 | Long |
| 4,656,827 | A | | 4/1987 | Puillet |
| 4,711,216 | A | | 12/1987 | Takeuchi et al. |
| 4,926,829 | A | | 5/1990 | Tuckey |
| 4,951,636 | A | | 8/1990 | Tuckey et al. |
| 5,044,890 | A | | 9/1991 | Loeffler et al. |
| 5,120,201 | A | | 6/1992 | Tuckey et al. |
| 5,237,975 | A | * | 8/1993 | Betki et al. ..... 123/456 |
| 5,355,859 | A | * | 10/1994 | Weber ..... 123/456 |
| 5,516,370 | A | * | 5/1996 | Karnauchow et al. ... 123/198 A |
| 5,848,583 | A | | 12/1998 | Smith et al. |
| 5,881,698 | A | | 3/1999 | Tuckey et al. |
| 6,155,235 | A | * | 12/2000 | Kilgore ..... 123/467 |
| 6,298,731 | B1 | | 10/2001 | Wade et al. |
| 6,302,144 | B1 | | 10/2001 | Graham et al. |
| 6,622,707 | B2 | | 9/2003 | Begley et al. |
| 6,889,656 | B1 | | 5/2005 | Rembold et al. |
| 7,043,960 | B1 | | 5/2006 | Lueck |
| 7,185,634 | B2 | | 3/2007 | Gardner et al. |
| 7,188,610 | B2 | | 3/2007 | Crary et al. |
| 7,207,319 | B2 | | 4/2007 | Utsumi |
| 7,234,293 | B2 | | 6/2007 | Yates et al. |
| 2002/0020397 | A1 | | 2/2002 | Begley et al. |
| 2004/0172188 | A1 | | 9/2004 | Bowling et al. |
| 2005/0284448 | A1 | | 12/2005 | Forgue et al. |
| 2006/0185631 | A1 | | 8/2006 | Fitzgerald |
| 2006/0236981 | A1 | | 10/2006 | Bickley |

* cited by examiner

*Primary Examiner*—Hieu T Vo
(74) *Attorney, Agent, or Firm*—Gallop, Johnson & Neuman

(57) ABSTRACT

A programmable fuel pump control for a fuel system includes integral sensors, an expansible fill chamber and a return chamber. The control can be used in either a return-style of returnless fuel system. The expansible fill chamber is in fluid communication with the fuel rail. A restrictable fuel passage connects the fill chamber to a return chamber that in a return-style fuel system can be optionally connected to a return line. The control includes an integral pressure transducer measuring fuel pressure relative to intake manifold pressure and one or more adjunct sensors that allow real time control of a fuel pump speed, and therefore fuel pressure, as a function of engine performance.

12 Claims, 5 Drawing Sheets

PROGRAMMABLE FUEL PUMP CONTROL

CROSS REFERENCE TO RELATED APPLICATION

Not applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to fuel systems and more particularly to fuel systems for fuel injected engines.

BACKGROUND OF THE INVENTION

The typical motor vehicle utilizes electronic fuel injection (EFI) to deliver fuel into the engine. The fuel injectors (solenoid valves) are electronically connected to an engine control module that controls the amount of fuel entering the engine via control of the solenoid valves. By changing the dwell time of the valves, the amount of fuel entering the engine can be controlled. Fluctuations in engine performance and operating conditions can affect fuel pressure in the fuel system and hence the amount of fuel entering the engine. There are essentially two types of EFI systems, return-style and returnless, that are utilized to control fuel pressure. Typical return-style EFI systems rely on mechanical means to control fuel system delivery pressure by utilizing a return line from a fuel pressure regulator. A returnless system must rely upon electronic means for fuel pressure control. In this regard, the typical returnless system regulates fuel pressure by means of a fuel rail pressure sensor connected to electronics that can control fuel pump speed.

FIG. 1 depicts a return-style fuel system that is well known in the prior art. As shown in FIG. 1, fuel system 1 for an engine-driven vehicle having EFI includes a fuel tank 2, a fuel pump 3 and a fuel line 4 that delivers fuel from pump 3 to fuel injectors 5 disposed in fuel rail 6. Fuel line 4 includes fuel filter 7 and check valve 8. Fuel injectors (solenoid valves) 5 are mounted inside rail 6 and deliver fuel into engine intake manifold 10 carried by the engine 11. In a typical engine layout, nozzles (not shown) of the individual fuel injectors 5 are positioned adjacent to the fuel/air intake ports of the associated cylinders (not shown) of the engine 11.

In a return-style fuel system, line 9 connects fuel rail 6 to a bypass-style fuel pressure regulator 12, which is in turn connected to return line 13 leading back to fuel tank 2. Fuel pump 3 of the typical return-style EFI fuel system is electrically driven and operates at a continuous (constant-speed) high flow rate while the bypass style fuel pressure regulator 12 returns unused fuel back to the tank. The engine management electronics can adjust dwell time of the fuel injectors 5 in response to a variety of engine operating conditions such as intake manifold pressure, throttle position, engine speed or oxygen level. Typically the engine management electronics do not modulate dwell time based upon fuel pressure proper. Hence, in a conventional return-style fuel system, fuel pressure is assumed to be at a proper level in the fuel rail 6 from the standpoint of setting fuel injector dwell times. The advantages of this fuel system include its simple operation and low cost, along with generally consistent fuel pressure that responds rapidly to sudden changes in demand for fuel flow to the engine.

The prior art fuel pressure regulator 12 operates to return over-pressurized, excess fuel to the tank. In this regard, fuel pressure regulator 12 acts like a gate and allows fuel to return to the tank only when a calibrated fuel rail pressure is reached. When this calibrated fuel pressure is reached, excess fuel will be permitted to return to the tank and fuel pressure in the fuel rail will be maintained. An example prior art fuel pressure regulator is depicted in FIG. 2. The prior art fuel pressure regulator includes an air chamber 17 and a fill chamber 14 that are separated from each other by a diaphragm 15. Air chamber 17 is plumbed to the engine intake manifold via vacuum line 25. Fill chamber 14 is fluidly connected to the fuel rail 6 via line 9. Fill chamber 14 and air chamber 17 are on opposite sides of diaphragm 15. The fuel pressure regulator adjusts fuel pressure of the fill chamber 14 (fuel pressure applied to the fuel injector valves) to be higher than manifold negative pressure acting on the air chamber 17 by a predetermined a degree (for example 2.5 atmosphere). In working operation, movement (expansion) of the diaphragm is opposed by the force of spring 18. Spring 18 biases diaphragm 15, which has an integral valve 16 on valve seat 19. For simplicity of explanation, when a difference between fuel pressure and manifold negative pressure becomes larger than a predetermined value, diaphragm 15 is forced up. Integral valve 16 moves in cooperation with diaphragm 15. As a result of the lifting of the valve, an opening degree of a throttle portion made up of the movable valve 16 and valve seat 19 becomes large enough to allow excess fuel to enter return passage 20 and flow back into the tank. By regulating fuel pressure in this fashion the prior art fuel pressure regulator maintains fuel pressure in fill chamber 14 at a constant pressure. This type of bypass style regulator is common on return-style fuel injection systems to allow change in fuel pressure as a function of intake manifold pressure.

Disadvantages of this system include a relatively high current draw in the system leading to higher fuel temperatures, particularly in high flow applications. Another disadvantage occurs in a fuel system having a constant speed pump. In such a system the electric fuel pump operates at a constant speed above maximum engine demand. This action requires the maximum operating current to the fuel pump during all engineered fuel demand operating conditions. During extended periods of fuel pump operation, operating temperatures can get high enough to cause fuel pump cavitation and pump failure. High flow fuel systems develop even higher current draw and demand for higher current levels.

Further disadvantages of this type of system include the limited ability to have the fuel pump speed effectively engage as a function of engine demand without the use of electronic control. Additionally, in this type of system, changes in fuel pressure result when the speed of the fuel pump changes due to fuel pressure regulator performance (regulation slope). Also, these systems when employed with bypass style regulators exhibit certain undesirable features. For example, these systems typically rely on the vehicle operator to manually set pump speed when operating at low speed, then increase speed during high engine demand.

FIG. 3 depicts a returnless fuel system 40. A returnless fuel system lacks regulator 12 and return line 13 and relies upon fuel pump modulation to control fuel pressures in the fuel rail. The prior art returnless fuel system uses a pressure transducer 22 measuring fuel rail pressure connected to an ECM 21.

ECM 21 may also differentially measure fuel rail pressure against intake manifold pressure via sensor 23. ECM 21 is electrically connected to fuel pump 3. In response to an input from the pressure transducer, ECM 21 can lower or raise the fuel pump speed (typically via pulse width modulation) to maintain constant pressure in the fuel rail as a function of engine demand. Advantages of this system include weight and cost savings due to the absence of the regulator and return line. Also, with this system the fuel pump draws less current. Less current draw during low engine demand improves efficiency and results in less heat in the overall fuel system, though in some cases fuel in the fuel rails is allowed to heat up during low engine demands.

The prior art returnless fuel system has certain disadvantages. Disadvantages include slower system reaction time in responding to sudden changes in engine flow demand. Additionally, this system requires an accumulator to dampen fuel pressure spikes. Also, the fuel pump of the returnless fuel system is designed to operate at lower power conditions during low engine demand. However, for high flow fuel systems, reaction time of returnless fuel systems can be disadvantageously limiting. During long periods of low engine demand, fuel temperatures in the fuel rail can also be inconsistent by not using a return line.

High power (high flow) fuel systems have particularly troublesome heat build-up problems. High current draw during idle and low cruise put extra strain on the vehicle charging system as well. To address these problems, electronic speed controllers are used to reduce the speed of the pump during low engine demand operating conditions. These systems, however, typically require the inconvenience of the vehicle operator having to manually set pump speed when operating at low speed, then increase speed during high engine demand.

SUMMARY OF THE INVENTION

This invention seeks to solve the foregoing problems associated with both return-style and returnless EFI fuel systems. The invention is directed to a programmable fuel pump control that can be used in both return-style and returnless fuel systems. The invention is further directed to a fuel system comprising the programmable fuel pump control. The fuel system comprises the novel programmable fuel pump control with an adjustable flow restrictor between a normally open relief valve connected to a diaphragm assembly housed within an expansible fill chamber. The expansible fill chamber is in fluid communication with the fuel rail and a return chamber that is in fluid communication with the return line. When employed with a return-style system the diaphragm assembly of the present invention fuel pump control is preferably set at a minimum pressure (approximately 25 psi) below normal operating fuel system pressure (approximately 40 psi). By tuning the diaphragm assembly in this fashion, the fuel pump control continually allows passage of fuel into the fill chamber, through the relief valve, then on through an adjustable restrictor valve and then on into the return line during engine operation. Only when the engine shuts off will the diaphragm assembly engage the valve seat. Hence, in contrast to a typical prior art bypass style regulator, the operating default position of the diaphragm assembly on the present invention fuel pump control is in a normally open position. However, because the fill chamber is expansible, it can buffer fuel pressure spikes.

The present invention programmable fuel pump control can also be employed with a returnless fuel system simply by tightening the valve restrictor to prevent fuel flow through the device. In this fashion, the expansible chamber operates as a true accumulator chamber. Using the return line, although adding complexity to the system, results in certain advantages. First, it allows for the continuous flow of fuel through the fuel rail, resulting in higher consistency of fuel temperatures. Second, it allows for the purging of vapors and air without having to remove these gases via fuel injectors.

The sensors of the preferred embodiment programmable fuel pump control include a comparative pressure sensing means, a fuel temperature sensor and a pressure sensor measuring absolute air pressure. The comparative pressure sensing means comprises sensing means disposed in the fuel pump control's fuel intake chamber and air chamber. The fuel intake chamber is in fluid communication with the fuel rail and the air chamber is in fluid communication with the engine intake manifold. In a preferred embodiment the comparative sensing means constitutes a first pressure transducer disposed between the fuel intake chamber and the air chamber that outputs a unitary signal based upon a comparative pressure measurement between the chambers.

The use of a comparative measurement of fuel rail pressure to intake manifold pressure as a variable to control pump speed is known in the prior art. However, the present invention fuel pump control also includes at least two more integral sensors, specifically a temperature sensor that measures the temperature of fuel in the fuel rail (intake chamber) and a second pressure transducer that measures absolute air pressure in the air chamber. The first pressure transducer, the temperature sensor and the second pressure transducer each output an analog signal and are designed for electrical connection to an ECM that analyzes those outputs.

A preferred embodiment fuel system comprises the preferred embodiment programmable fuel pump control and can be either a returnless or return-style system. When employed as part of a return-style system, the fuel pump control is disposed in the return line between the fuel rail and the fuel tank. In the preferred embodiment fuel system, fuel is allowed to return back to the tank at a slowed rate. The returning fuel is able to purge gases without the requirement of being purged via fuel injectors. Returning fuel back to the fuel tank allows more consistent temperatures, as fuel is heated by the fuel rails during low engine demand operating conditions.

By virtue of the integral sensors (temperature and transducers), the fuel system employing the programmable fuel pump control of the present invention can supply fuel from a tank to a fuel-injected engine in response to the fuel demand of the engine. By also utilizing temperature and absolute air pressure inputs, the present invention fuel pump control monitors the precision of its fuel system control and reacts in real time to changes in engine demand. Hence, engine tuners can utilize the device in both return-style and returnless systems and program fuel pressure as a function of engine performance using inputs of fuel pressure, fuel temperature and manifold pressure via interface with an ECM. The pressure control system ECM may be part of the overall engine electronic control module or a stand-alone unit. The preferred embodiment programmable fuel pump control can be adapted for use in existing fuel systems by reprogramming existing engine or fuel system control units to receive and analyze the outputs from the first pressure transducer, the temperature sensor and the second pressure transducer and output a pump control signal based upon same.

When used as part of a return-style system, it is a further feature of the fuel system of the present invention that should the pump supply more fuel than that required by the operating engine, excess fuel is diverted from the engine by the pressure control system back to the fuel tank. However, in contrast to typical return-style systems, the returning fuel flow rate is relatively small.

The disclosed preferred embodiment return-style fuel system may further comprise an engine safety control relay that is triggered by the ECM in the event fuel pressure is too low over a determined period of time. If the value of a pressure reading is too low over a given period of time, the safety relay is engaged to protect the engine by shutting down the fuel system. This engine control relay can alternatively interrupt power to the fuel injectors, engine ignition system, the engine management electronics or the fuel pump. This action is used to protect the engine from possible damage as well as shut down the fuel system in the event of excessive fuel leakage or a failed fuel line.

Other objects, features and advantages of the present invention will be readily appreciated, as the same becomes better understood, after reading the subsequent description taken in conjunction with the accompanying drawings.

DETAILED DESCRIPTION OF THE PREFERRED EMBODIMENT

Figure 1:
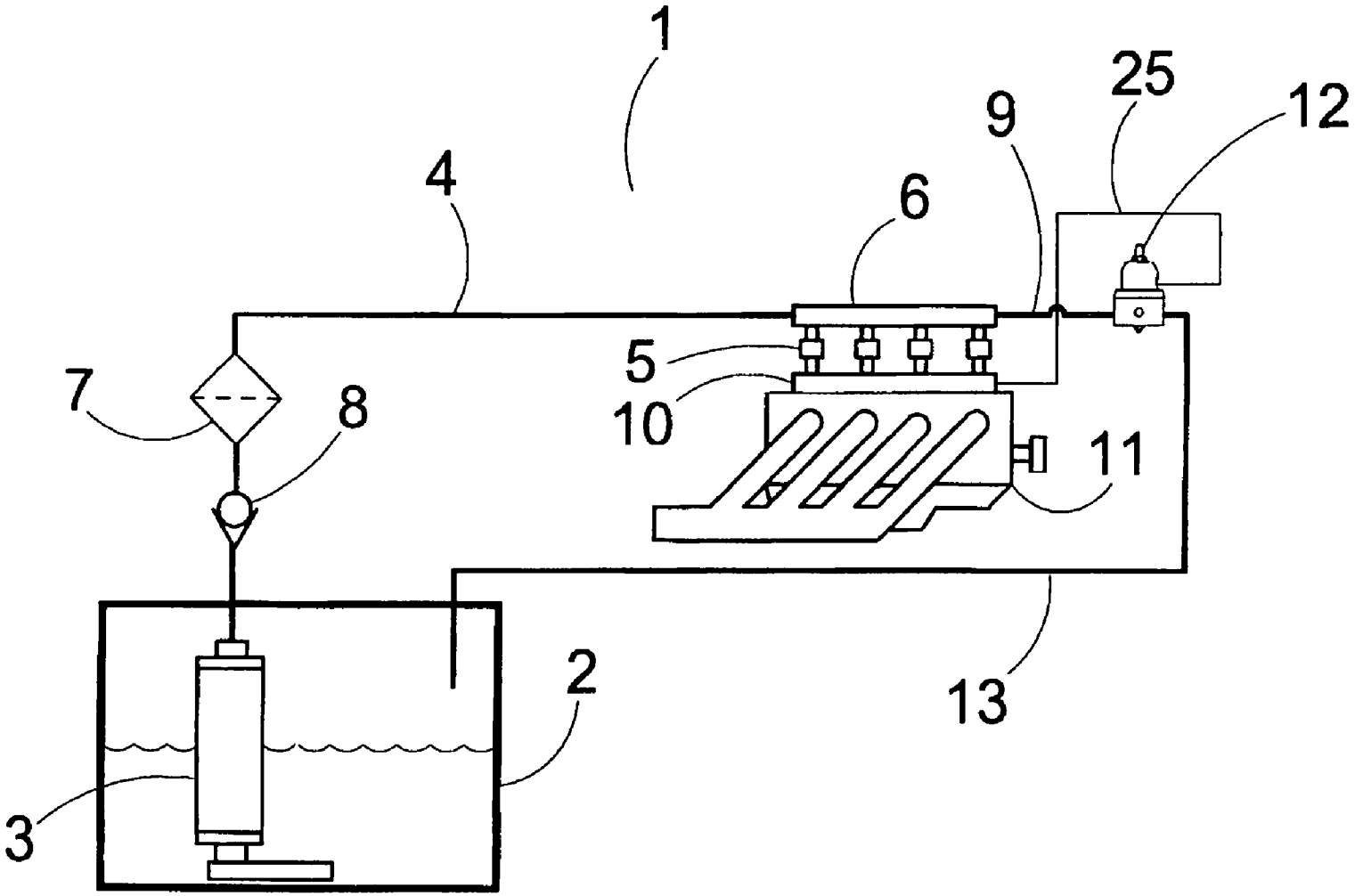
FIG. 1 is a schematic diagram of a prior art return-style fuel system.
Figure 2:
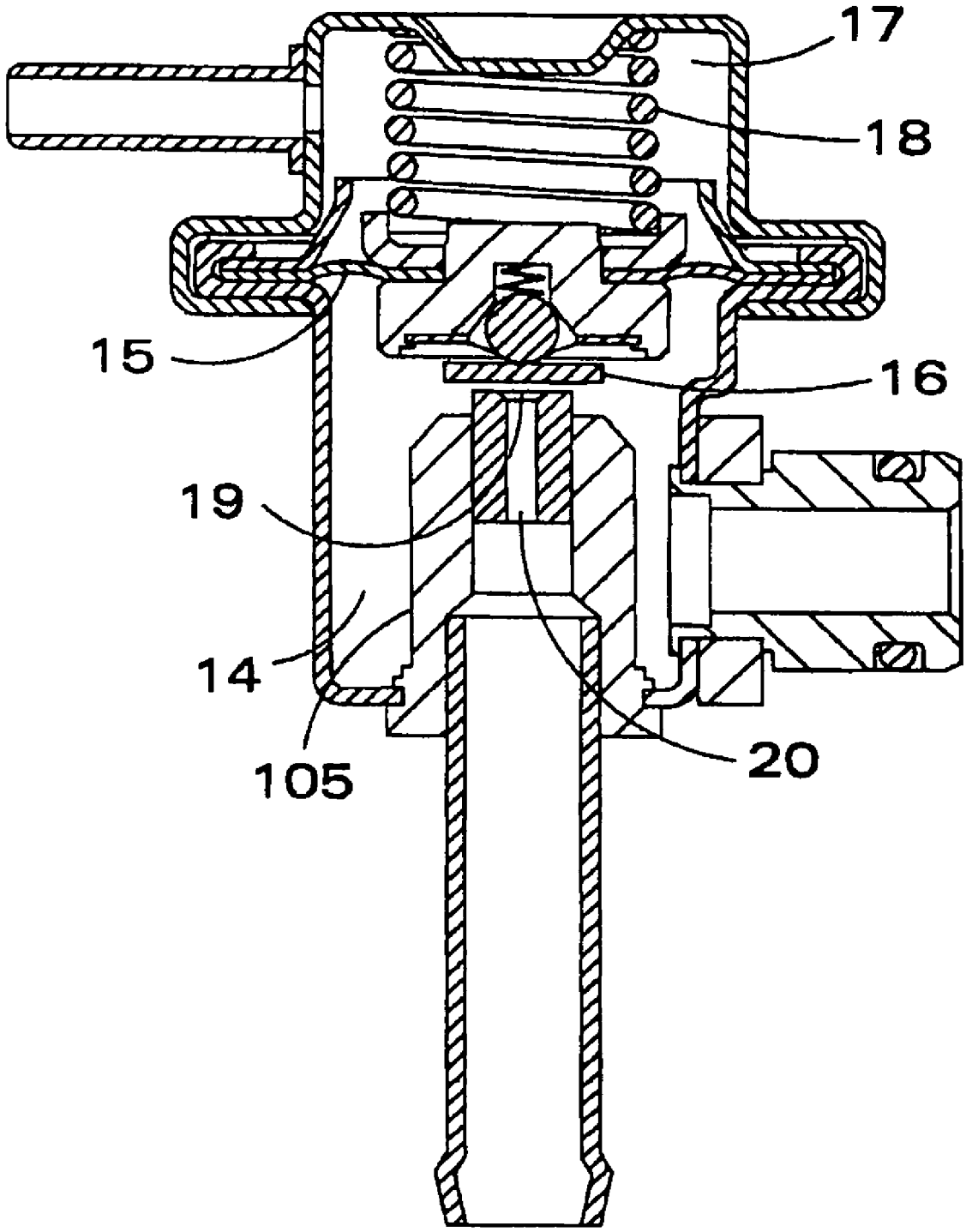
FIG. 2 is a sectional elevation view of a prior art fuel pressure regulator.
Figure 3:
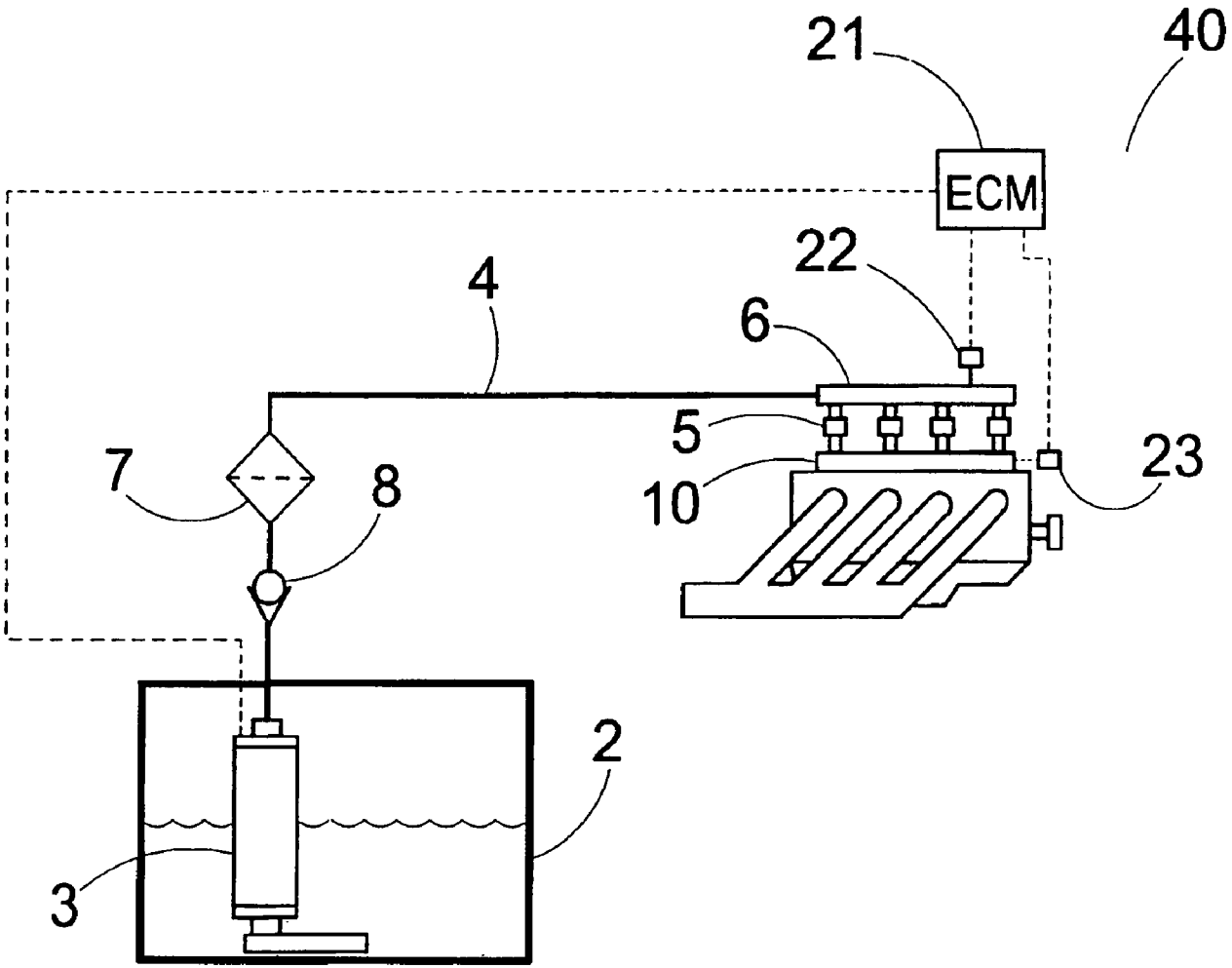
FIG. 3 a schematic diagram of a prior art returnless fuel system.
Figure 4:
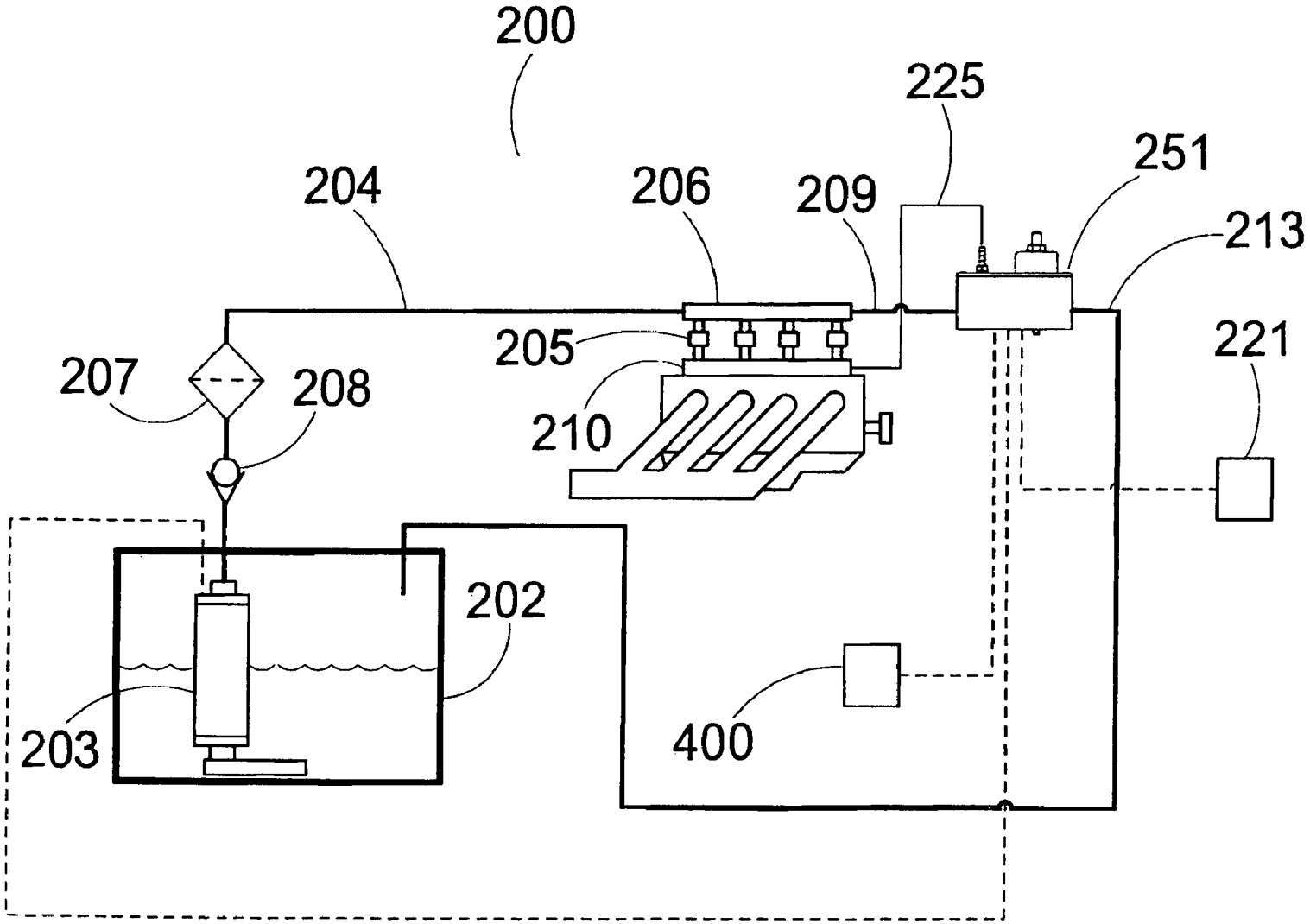
FIG. 4 is a schematic diagram of a preferred embodiment fuel system in accordance with of the present invention.

FIG. 4 illustrates a preferred embodiment return-style fuel delivery system 200 of the present invention for an engine with fuel injection. As shown in FIG. 4, fuel in tank 202 is pumped by the fuel pump 203 through check valve 208, fuel filter 207, fuel line 204 and on to the engine fuel rail 206. Fuel injectors 205 deliver fuel from fuel rail 206 into engine intake manifold 210 to be used by the engine. Excess fuel from the fuel rail 206 is passed through fuel line 209 to the programmable fuel pump control 251. When control 251 is employed as part of a return-style fuel system, fuel exiting fuel pump control 251 is returned back to tank 202 via return line 213.

Figure 5:
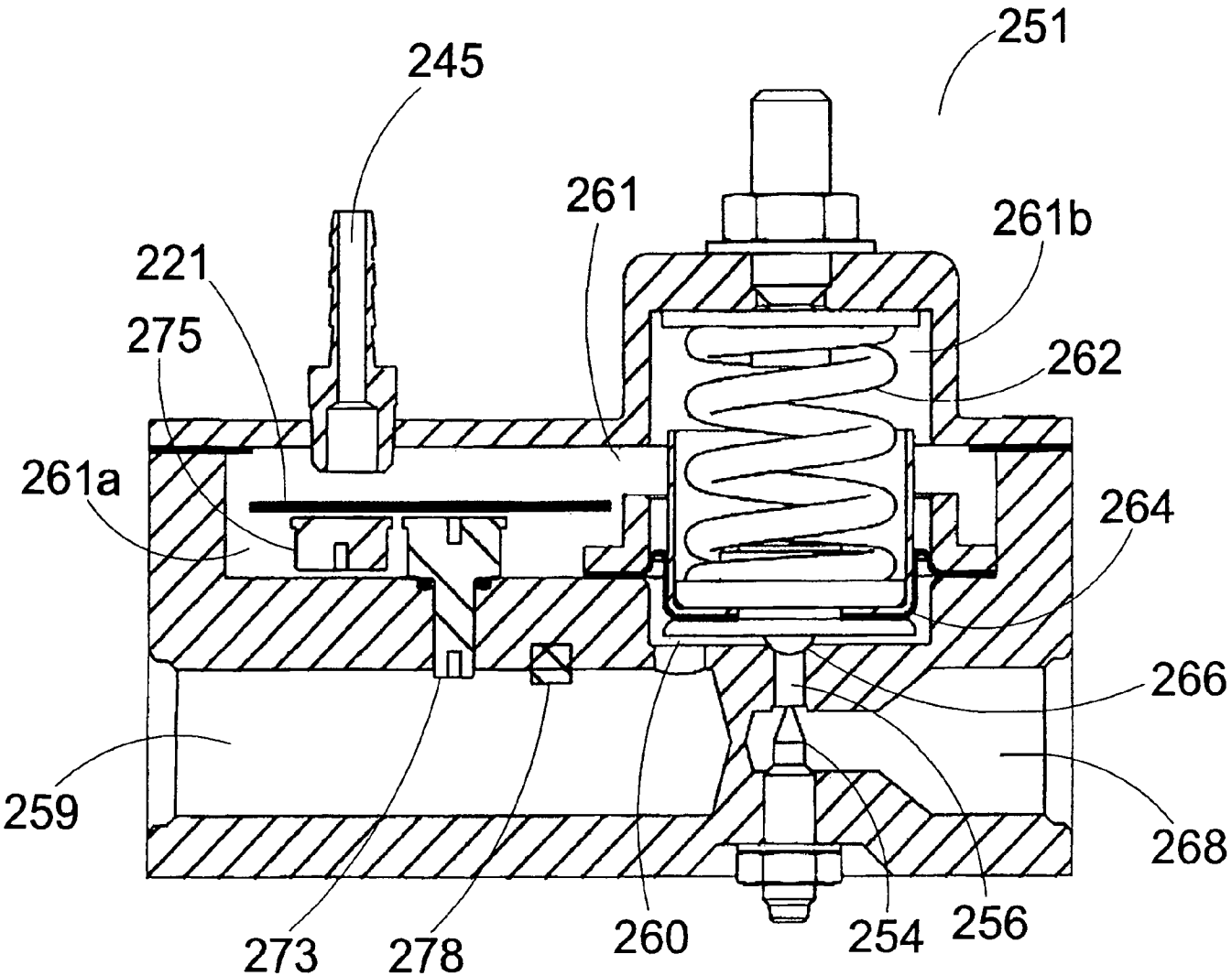
FIG. 5 is a sectional elevation view of a preferred embodiment programmable fuel pump control of the present invention and disclosed in the embodiment fuel system of FIG. 4.

FIG. 5 depicts a preferred embodiment programmable fuel pump control. To provide for differential pressure analysis, fuel pump control 251 is fluidly connected to fuel rail 206 and engine intake manifold 210. In this respect line 209 delivers excess fuel from fuel rail 206 to fuel intake chamber 259 of pump control 251. Additionally, port 245 of fuel pump control 251 is plumbed to engine intake manifold 210 via vacuum line 225. By virtue of vacuum line 225, diaphragm assembly 264 can be tuned for changing intake manifold pressures in order to establish a relatively constant pressure drop across fuel injectors 205. As shown in FIG. 5 the programmable fuel pump control 251 includes adjustable flow restrictor 254. In a preferred embodiment adjustable flow restrictor 254 is a needle valve. In an alternate embodiment, adjustable flow restrictor 254 could be a changeable orifice.

Programmable fuel pump control 251 operates as follows. Fuel from fuel rail 206 flows via line 209 and into fuel intake chamber 259. Fuel entering intake chamber 259 flows on into fuel fill chamber 260 with low restriction. It will be appreciated that chamber 259 of fuel pump control 251 is in essential fluid communication with fuel rail 206 and therefore the pressure of fuel in chamber 259 will equate to the pressure of fuel in fuel rail 206. Air chamber 261 is plumbed via port 245 into vacuum line 225 and hence is in fluid communication with engine intake manifold 210. Fuel enters intake chamber 259 from fuel rail 206 and passes with minimal restriction on in to expansible fuel fill chamber 260, one wall of which is defined by diaphragm assembly 264. Expansible fuel fill chamber 260 and air chamber 261 are on opposite sides of diaphragm assembly 264. For conceptualization purposes, air chamber 261 comprises two areas: area 261*a*, proximal to port 245 and housing the sensors hereinafter described; and area 261*b*, housing conventional diaphragm assembly components.

Air pressure in air chamber 261 acts upon one side of diaphragm assembly 264 while fuel pressure in fill chamber 260 exerts a force over the opposite side of diaphragm assembly 264 which is opposed by biasing spring 262. When fuel pump control 251 is employed as part of a return-style system, diaphragm assembly 264 is set at a minimum pressure below normal operating fuel system pressure (approximately 40 psi). By tuning the diaphragm assembly in this fashion, the fuel pump control continually allows passage of fuel into fill chamber 260 and into passage 256. Once fuel enters passage 256 it will pass through adjustable valve 254 and then on into return chamber 268. Return chamber 268 is connected to optional return line 213. As tuned, diaphragm assembly 264 will engage valve seat 266 only when the engine shuts off. During engine operation when the force of the bias spring 262 is counteracted by the difference of the fuel pressure in fill chamber 260 minus air pressure in air chamber 261 the diaphragm assembly 264 is allowed to move upwardly to allow more fuel to enter chamber 260. By adjustment of adjustable flow restrictor 254 the amount of fuel returning back to the fuel tank can be regulated.

Pump control 251 includes integral comparative pressure sensing means 273, fuel temperature sensing means 278 and absolute air pressure sensing means 275. Comparative pressure sensing means 273 measures fuel rail pressure relative to manifold air intake pressure and outputs a signal in accordance with that measurement to ECM 221. In a preferred embodiment, ECM 221 is contained within the housing of pump control 251. In a preferred embodiment, comparative pressure sensing means 273 is a first pressure transducer adapted to receive dual inputs and disposed between intake chamber 259 and chamber 261. Sensor 275 is disposed within chamber 261. Sensor 275 measures absolute air pressure in chamber 261 (and hence manifold air intake pressure) and outputs a signal to ECM 221 in accordance with that measurement. Sensor 278 is disposed within intake chamber 259 and measures fuel temperature. Sensor 278 outputs a signal to ECM 221 based upon that temperature measurement.

Diaphragm assembly 264 is set to expand at a minimum pressure below normal operating fuel system pressure (approximately 40 psi). By tuning the diaphragm assembly in this fashion, the fuel pump control continually allows passage of fuel into fill chamber 260. During engine operation as the force of the bias spring 262 is counteracted by the difference of the fuel pressure in fill chamber 260 minus air pressure in air chamber 261 the diaphragm assembly 264 is allowed to move upwardly to allow more fuel to accumulate in fill chamber 260 to offset pressure spikes. When a return line is employed, fuel is allowed to return back to the fuel tank at a relatively low rate. This allows the fuel to have a greater thermal consistency. It also aids in reducing the purging of trapped vapors through the fuel injectors, a situation that can cause improper air-fuel mixtures to enter the engine.

A preferred embodiment returnless fuel system would include programmable fuel pump control 251 along with all other fuel system components except return line 213. When pump control 251 is employed as part of a returnless system, the system is simplified whereas a return line is not required to be employed. When used in a returnless system, adjustable valve 254 is therefore closed or return port plugged to prevent escape of fuel.

ECM 221 receives the output signals from the one or more integral adjunct sensors 273, 275 and 278 and is programmed to calculate a desired fuel pressure based upon those signals. In accordance with that calculation ECM 221 outputs a speed control signal to fuel pump 203 to maintain the calculated desired fuel pressure. For example, the inclusion of integral temperature sensor 278 in conjunction with ECM 221 allows the user to program pressure change as a function of fuel temperature.

In contrast to typical fuel management units that use only fuel rail or intake manifold pressure to regulate pump speed, the fuel system of the present invention utilizing fuel pump control 251 having the comparative pressure sensing means along with temperature and absolute air pressure sensing, provides for automatic control of fuel pump speed based upon multiple inputs reflecting engine fuel demand conditions. It will be appreciated from the above description that, unlike other fuel systems, the fuel system of the present invention utilizes actual engine performance data (instead of just intake fuel rail and intake manifold pressure) as an input to control pump speed, and hence fuel pressure. Hence, the fuel system and programmable fuel pump control of the present invention provide advantages over fuel management units by using real time engine parameters to control fuel pressure. Users of the invention can not only alter the pressure as a function of varying intake manifold conditions, but can also allow other engine operating conditions to effect the desired fuel pressure. In this regard, the ECM can be adapted to receive additional inputs such as throttle position or engine speed to adjust fuel pressure. By providing for the disclosed embodiment fuel system employing the fuel pump control with a programmable ECM, fuel pressure can more accurately reflect the desired fuel delivery. This results in improved performance over a wider range of operating conditions than is allowed by prior art fuel systems.

In an alternate embodiment comparative pressure sensing means 273 could comprise two independent signal outputting pressure transducers housed respectively in chambers 259 and 261. In which case second pressure transducer 275 would not be necessary. However, ECM would be programmed to output a pump speed-control signal based upon both absolute air pressure and air pressure relative to fuel pressure.

Programmable fuel pump control 251 can be purchased as an aftermarket fuel system component to provide an input to utilize in controlling fuel system pressure in both return-style and returnless fuel systems. In a fuel system without an electronic fuel management unit, ECM 221 would need to be provided. In a fuel system with an existing fuel management unit, the fuel management unit could be reprogrammed or reconstructed to receive the output from sensors 273, 275 and 278 and output a fuel pump speed-control power signal based upon those outputs. Alternatively, as shown in FIG. 5, the microprocessor electronics of ECM 221 could be adapted for inclusion within the housing of the fuel pump to provide for a self-contained unit.

The fuel pump control with programmed ECM is particularly adapted for aftermarket use. By using this invention, engine tuners (people who set-up modified EFI engine systems) can adapt existing systems with very little effort or modification. For example, using a bypass style regulator also enables the fuel system to react normally and preserve high-pressure stability, such as is found in returnless or engine demand based fuel systems. Using the invention allows a return line to be used to keep temperatures in the fuel system more consistent, while providing for more accurate tuning of the fuel system to respond to varying engine demands. Moreover, the programmable fuel pump control of the present invention can be used to convert a return-style system to a returnless system and vice versa.

In a preferred embodiment fuel system, fuel pump speed control is accomplished using an input signal from the sensors to the ECM to electronically control the fuel pump. The preferred embodiment fuel system 200 may further comprise safety relay 400. The ECM of each preferred embodiment fuel systems may be programmed such that if the fuel system fails to supply desired fuel pressure over a given period of time, safety relay 400 is engaged (via a signal from the ECM) to protect the engine and shut down the engine management electronics, the fuel system, engine ignition or fuel injector operation. For purposes of image simplicity, the circuitry connecting relay 400 to these systems is omitted from FIG. 4. This relay action can be used as a safety to shut down the fuel system in the event of catastrophic fuel system failure. When the pressure transducer reading is too low, the engine may not be getting adequate fuel delivery. Over a given period of time (typically less than one second) relay 400 can engage and interrupt engine functions to prevent engine damage. For example, if the fuel line 204 fails due to excessive leakage or rupture, safety relay 400 will engage and shut down power to fuel pump 202.

The present invention fuel pump control can be applied to carbureted fuel delivery systems. The invention can also apply to other hydraulic or fluid pumping systems. Aerospace applications for both manned and unmanned vehicle systems can apply as well. Other types of industrial and laboratory applications can also apply, as this system also greatly increases efficiency of constant pressure, variable flow hydraulic pumping systems.

What is claimed is:

1. A fuel pump control for use in a fuel system supplying fuel to a fuel injected engine, the engine having a fuel rail, one or more fuel injectors communicating between the fuel rail and an engine air intake manifold and the fuel system having a fuel tank, a fuel pump for delivery of fuel from the fuel tank to the fuel rail and a pre-determined fuel system normal operating pressure, the fuel pump control comprising:

an air chamber, a fuel intake chamber, an expansible fill chamber and a return chamber;

the fuel intake chamber adapted for fluid connection to the fuel rail;

the air chamber adapted for fluid connection to the engine air intake manifold;

the expansible fill chamber being in fluid connection with the fuel intake chamber;

a fuel passage disposed between the expansible fill chamber and the return chamber;

a restrictor valve adapted to control and shut off the flow of fuel through the fuel passage from the expansible fill chamber to the return chamber;

the return chamber being adapted for fluid connection to a return line allowing return of fuel to the fuel tank;

the expansible fill chamber having at least one surface defined by a motile diaphragm assembly, the motion of the diaphragm assembly being regulated by the pressure of fuel in the fuel rail and air pressure in the engine air intake manifold;

first sensing means measuring relative pressure of air pressure in the air chamber and fuel pressure in the fuel intake chamber and outputting an electric signal based upon that relative pressure;

second sensing means disposed within the fuel pump control and measuring the temperature of fuel entering the intake chamber and outputting an electric signal based upon that temperature; and third sensing means disposed within the air chamber and measuring absolute air pressure within the air chamber and outputting an electric signal based upon that measurement.

2. The fuel pump control of claim 1 wherein the diaphragm assembly is adapted to allow the flow of fuel into the expansible fill chamber and on into the return chamber upon the difference in pressure of fuel in the fuel rail and pressure of air in the engine air intake manifold reaching a second pre-determined pressure and the second pre-determined pressure is below the pre-determined fuel system normal operating pressure.

3. The fuel pump control of claim 1 wherein the first sensing means comprises a unitary sensor adapted to receive dual pressure inputs and is disposed between the air chamber and the fuel intake chamber.

4. The fuel pump control of claim 1 wherein the first sensing means comprises two independent pressure transducers respectively disposed in the air chamber and fuel intake chamber.

5. The fuel pump control of claim 1 wherein the adjustable restrictor valve is a needle valve or a changeable orifice.

6. The fuel pump control of claim 1 further comprising an electronic control module adapted to receive one or more of the output signals from the first, second or third sensing means and output a fuel pump control signal based upon those one or more received signals.

7. The fuel system of claim 6 wherein the diaphragm assembly is adapted to allow the flow of fuel into the expansible fill chamber upon the difference in pressure of fuel in the fuel rail and pressure of air in the engine air intake manifold reaching a second pre-determined pressure and the second pre-determined pressure being is below the pre-determined normal fuel system operating pressure.

8. The fuel system of claim 6 further comprising a return line in fluid communication with the return chamber and the fuel tank.

9. The fuel system of claim 6 further comprising a safety relay in electric communication with the electronic control module and one or more of the following components: the engine management electronics, the fuel pump, ignition system or the one or more fuel injectors.

10. The fuel system of claim 6 wherein the adjustable valve is a needle valve or changeable orifice.

11. The fuel system of claim 6 further comprising one or more electronic devices that output a signal as a function of fuel rail pressure, throttle position, engine speed, or fuel injector operation and the electronic control module is adapted to receive the signals from the one or more electronic devices and output a speed-control signal to the fuel pump based upon those signals.

12. A fuel system having a normal operating pressure for supplying fuel from a tank to a fuel injected engine, the engine having an ignition system, a fuel rail, one or more fuel injectors communicating between the fuel rail and an engine air intake manifold, the system comprising:

a fuel tank, a fuel pump for delivery of fuel from the fuel tank to the fuel rail end and a fuel pump control;

the fuel pump control comprising:

a fuel intake chamber adapted for fluid connection to the fuel rail, an air chamber adapted for fluid connection with the engine air intake manifold and a fuel passage disposed between an expansible fill chamber and a return chamber;

the expansible fill chamber being in fluid connection with the fuel intake chamber;

a restrictor valve being adapted to control and shut off the flow of fuel through the fuel passage from the expansible fill chamber to the return chamber;

the return chamber being adapted for fluid connection to a return line allowing return of fuel to the fuel tank;

the expansible fill chamber having at least one surface defined by a motile diaphragm assembly, the motion of the diaphragm assembly being regulated by the pressure of fuel in the fuel rail and air pressure in the engine air intake manifold;

first sensing means measuring relative pressure of air pressure in the air chamber and fuel pressure in the fuel intake chamber and outputting an electric signal based upon that relative pressure;

second sensing means measuring the temperature of fuel entering the fuel intake chamber and outputting an electric signal based upon that temperature; and third sensing means measuring absolute air pressure within the air chamber and outputting an electric signal based upon that measurement an electronic control module electrically connected to the first, second and third sensing means and the fuel pump;

the electronic control module adapted to receive one or more of the signals from the first, second and third sensing means and output a speed-control signal to the fuel pump based upon those one or more signals.

* * * * *